US010443379B2

(12) United States Patent
Fitzel et al.

(10) Patent No.: US 10,443,379 B2
(45) Date of Patent: Oct. 15, 2019

(54) APPARATUS AND METHOD FOR TESTING AN OIL AND/OR GAS WELL WITH A MULTIPLE-STAGE COMPLETION

(71) Applicants: Steve Fitzel, Calgary (CA); Dave Jellett, Calgary (CA); Trevor Coleman, Millet (CA); Jeremy Thompson, Airdrie (CA); Karen Osadchuk, Calgary (CA)

(72) Inventors: Steve Fitzel, Calgary (CA); Dave Jellett, Calgary (CA); Trevor Coleman, Millet (CA); Jeremy Thompson, Airdrie (CA); Karen Osadchuk, Calgary (CA)

(73) Assignee: Pursuit Technologies Ltd., Calgary, Alberta (CA)

( * ) Notice: Subject to any disclaimer, the term of this patent is extended or adjusted under 35 U.S.C. 154(b) by 149 days.

(21) Appl. No.: 15/624,380

(22) Filed: Jun. 15, 2017

(65) Prior Publication Data

US 2018/0363460 A1 Dec. 20, 2018

(51) Int. Cl.

| | |
|---|---|
| ***E21B 33/124*** | (2006.01) |
| ***E21B 47/06*** | (2012.01) |
| ***E21B 49/08*** | (2006.01) |
| ***E21B 33/12*** | (2006.01) |
| ***E21B 34/08*** | (2006.01) |

(Continued)

(52) U.S. Cl.

CPC ..... *E21B 49/081* (2013.01); *E21B 33/12* (2013.01); *E21B 33/124* (2013.01); *E21B 34/08* (2013.01); *E21B 47/10* (2013.01); *E21B 49/084* (2013.01); *E21B 49/087* (2013.01); *E21B 23/00* (2013.01); *E21B 43/128* (2013.01); *E21B 47/06* (2013.01); *E21B 47/065* (2013.01); *E21B 47/12* (2013.01); *E21B 2049/085* (2013.01)

(58) Field of Classification Search

CPC ..... E21B 33/124; E21B 33/1243; E21B 33/1246; E21B 49/081; E21B 47/06; E21B 47/065

See application file for complete search history.

(56) References Cited

U.S. PATENT DOCUMENTS 3,876,003 A * 4/1975 Kisling, III ..... E21B 33/1246 166/187
4,860,581 A * 8/1989 Zimmerman ..... E21B 49/081 73/152.26

(Continued)

*Primary Examiner* — Cathleen R Hutchins
(74) *Attorney, Agent, or Firm* — Gowling WLG (Canada) LLP

(57) ABSTRACT

The present disclosure relates to testing tools that comprises: a cable-head assembly for connecting the testing tool to an end of a length of coiled tubing; a pump assembly comprising a downhole pump; an upper packer-assembly comprising an upper packer-element; a lower packer-assembly comprising a lower packer-element; a sensor assembly comprising one or more sensors with the sensor assembly positioned in fluid communication with a plenum between the upper and lower packer assemblies; and a testing port that is adjacent the sensor assembly. The testing tool is moveable between a first configuration where the upper and lower packer-elements are unset and a second position where the upper and lower packer-elements are set and the testing port is in fluid communication with the downhole pump. Methods of using the testing tools is also described.

18 Claims, 9 Drawing Sheets

(51) Int. Cl.

| | |
|---|---|
| ***E21B 47/10*** | (2012.01) |
| *E21B 43/12* | (2006.01) |
| *E21B 23/00* | (2006.01) |
| *E21B 47/12* | (2012.01) |

(56) References Cited

U.S. PATENT DOCUMENTS 5,291,947 A * 3/1994 Stracke ..... E21B 33/1243
166/187
5,984,006 A * 11/1999 Read ..... E21B 17/028
166/242.2
7,913,557 B2 * 3/2011 Vasques ..... E21B 33/1246
73/152.55

* cited by examiner

APPARATUS AND METHOD FOR TESTING AN OIL AND/OR GAS WELL WITH A MULTIPLE-STAGE COMPLETION

CROSS REFERENCE TO RELATED APPLICATIONS

This application claims the benefit of priority of U.S. Provisional Patent Application No. 62/350,572, filed on Jun. 15, 2016, the entire disclosure of which is incorporated herein by reference.

TECHNICAL FIELD

This disclosure generally relates to production of hydrocarbons. In particular, the disclosure relates to an apparatus and method for testing an oil and/or gas well that has been completed with single stages or multiple stages.

BACKGROUND

With advances in drilling technology it has become increasingly common to drill oil and/or gas wells that have sections that are deviated from a vertical orientation. In some wells one or more sections may be at least partially horizontal. A well with such a horizontal section may also be referred to as non-vertical well, a lateral well, a deviated well or a horizontal well. As a method to increase production from these horizontal wells the wellbores are first cased. The casing may then be perforated or otherwise opened in intervals at specific locations.

Various approaches are used for creating an opening or perforation in the casing. Such approaches include, but are not limited to: explosive perforating, use of screens and sliding sleeves, burst discs, and abrasive jetting each of which can provide fluid communication between the inside and outside of the casing.

Next a portion or all of the horizontal wells can be subjected to a fracturing operation. The fracturing operation generates cracks within a geologic formation surrounding the horizontal well. The cracks provide a fluid pathway for facilitating fluid communication between the wellbore and an oil and/or gas containing reservoir within the geologic formation. Different fracturing methods are used to generate the cracks including, but not limited to pumping a high-pressure fracturing mixture of fluid and proppant into each stage of well and the local geological formation individually. Fracturing surface-pressures and flow rates are monitored to determine the breakdown pressures and effectiveness of the fracturing operation. However, things can go wrong while pumping the fracturing mixture. For example, sand within the fracturing mixture can plug off flow through one or more cracks; pumps can malfunction; and characterization of the reservoir resistance can be inaccurate. These and other known issues can result in a less-than-ideal fracturing operation.

It also common that different portions of the same geologic formation will respond differently to the fracturing operation. This can result in different production rates between the stages of the horizontal well. The cracks tend to follow the path of least resistance in the geologic formation, which results in complex flow paths for the fluids to flow from the reservoir to the wellbore. The width of the fracture, the tortuosity of the fluid path and the amount of proppant in the fracture can all affect the production rate of fluids through a given crack.

Furthermore, one or more stages of the well may end up producing water from the geologic formation. For example, one stage may intersect with a water layer and produce more water than other stages of the horizontal well. Water has lifting and separating costs that impact the economics of the well's production. There are known methods that attempt to improve the well's economics by reducing the quantity of produced water using plugging gel fluids or mechanical shut-off devices. These methods require, however, that the well operator knows which stages of the well are producing the problematic water.

It has been estimated that only 25% of the fractured stages in a horizontal well provide significant oil and/or gas production. Very few direct measurements of each individual stage have been done because there are limited efficient manners to measure the characteristics of the fractured sections portions of the geologic formation or the nature of the fluids that are produced therefrom. Most measurements, such as a draw-down test, are performed on a well as a whole collective-unit by measuring a pressure response from the well based on rate changes provided at surface.

SUMMARY

Embodiments of the present disclosure relate to a testing tool that includes an uphole end and a downhole end, the uphole end is operatively connectible to a coiled tubing string; a downhole pump; an upper packer-assembly and a lower packer-assembly; a sensor assembly comprising one or more sensors, the sensor assembly in fluid communication between the packer assemblies and the downhole pump; and a flow-through conduit for conducting fluids between the uphole end and the downhole end.

In some embodiments of the present disclosure the testing port may be in fluid communication with the downhole pump independent of the configuration of the testing tool.

Some embodiments of the present disclosure may be used to evaluate fracturing effectiveness, estimate the stimulated reservoir volume (SRV), a reservoir ultimate recovery or other reservoir properties that can be measured by pressure or rate transient analysis techniques known to those skilled in the art.

Some embodiments of the present disclosure may also be used to test individual stages of a horizontal section of a well for produced water, other unwanted fluids and to evaluate the effectiveness of water, steam, polymer or gas flooding procedures for enhanced oil-recovery processes.

Some embodiments of the present disclosure relate to testing tools that provide a fluid flow-through conduit through which fluids can pass from one end of the testing tool to the other. The implication of which is that testing tools of the present disclosure will not block fluid communication between a source of fluid and any hydraulically-actuated tools that are positioned within the well and downhole of the testing tool. Furthermore, the fluid conduit can be used to clear debris within and below the testing tool.

Some embodiments of the present disclosure relate to testing tools that can be connected directly to one end of a coiled tubing string. This connection allows fluids to be introduced into the testing tool from surface through the coiled tubing string. This connection also allows the testing tool to be physically moved within a well by moving the coiled tubing.

Some embodiments of the present disclosure also relate to testing tools that can be powered by a single conductor-cable. Without being bound by any particular theory, the single conductor-cable may make the setup, running in-andout of the well and operation of the testing tool simpler and more cost efficient than known testing tools that are powered by multiple conductor-cables. In other embodiments of the present disclosure the testing tools can be powered by multiple conductors that are run into the well with the coiled tubing string.

Some embodiments of the present disclosure relate to testing tools that employ an electrically-powered, mechanically-driven downhole pump. Without being bound by any particular theory, a mechanically-driven downhole pump may provide precise control over the volume of test fluids that are drawn into the sensor assembly for testing. Precise control over the volume of test fluids that are being tested may provide more accurate information regarding the properties of the test fluids, the extent and quality of the fracturing operation and the geological formation from which the test fluids are produced.

Some embodiments of the present disclosure relate to testing tools that can be used to test the breakdown strength of rock or other geological formations, which may be informative for assessing cap rock integrity in oil sand steam flood projects. In these embodiments, the pumping direction of the downhole pump can be reversed from when the testing tool is used to test the produced fluids, fracturing operation extent and quality and the geological formation.

Some embodiments of the present disclosure relate to a method for testing a multistage well-completion. The method comprises some or all of the following steps: connecting a testing tool to one end of coiled tubing; running the coiled tubing and the testing tool into a well; positioning the testing tool substantially adjacent a desired perforated section of the well; setting a first packer element of the testing tool on one side of the desired perforated section of the well and a second packer element of the testing tool on an opposite side of the desired perforated section; establishing fluid communication between a sensor assembly of the testing tool and the desired perforated section; pumping fluid through a downhole pump of the testing tool at a first output parameter; capturing fluid-property data and/or pressure data from the test fluids as they are drawn towards the downhole pump; and unsetting the packer elements.

BRIEF DESCRIPTION OF THE DRAWINGS

These and other features of the present disclosure will become more apparent in the following detailed description in which reference is made to the appended drawings.

FIG. 2 is a longitudinal, mid-line cross-sectional view of the testing tool of FIG. 1, wherein

FIG. 3 is a longitudinal, mid-line cross-sectional view of the testing tool of FIG. 1 with a closer view towards a downhole end of the testing tool, wherein

FIG. 9 is a schematic diagram of a method for using the testing tools of the present disclosure, wherein

DETAILED DESCRIPTION

The present disclosure relates to an apparatus and method of testing an oil and/or gas well that has been completed with one or multiple stages.

Definitions:

Unless defined otherwise, all technical and scientific terms used herein have the same meaning as commonly understood by one of ordinary skill in the art to which this disclosure belongs.

As used herein, the term "about" refers to an approximately +/−10% variation from a given value. It is to be understood that such a variation is always included in any given value provided herein, whether or not it is specifically referred to.

Embodiments of the present disclosure will now be described by reference to FIG. 1 through FIG. 8, which show representations of testing tools and testing methods according to the present disclosure.

Figure 1:
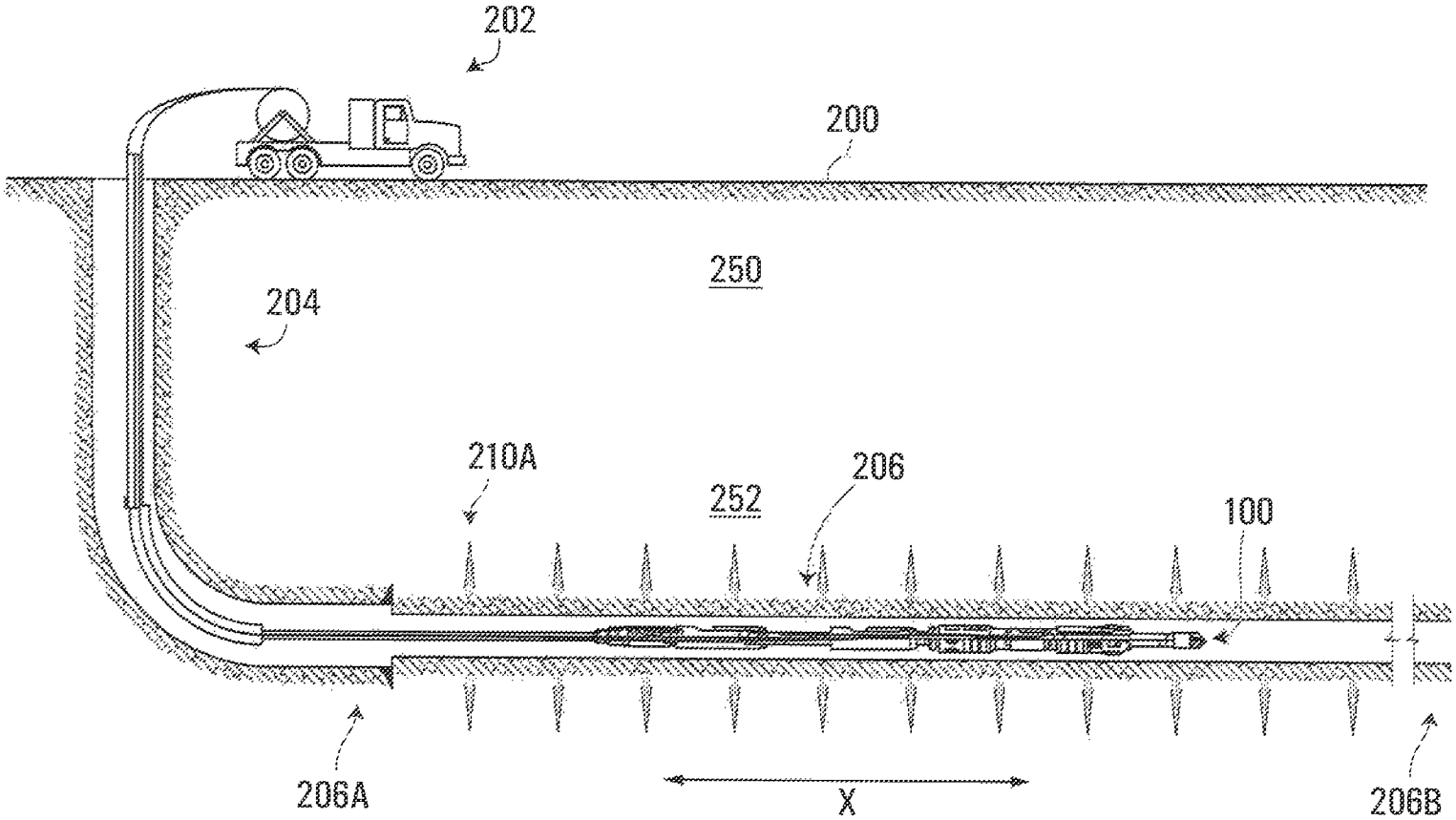
FIG. 1 is a schematic diagram of one embodiment of a testing tool according to the present disclosure, the testing tool is positioned within a horizontal oil and/or gas well and it is fluidly and mechanically connected to topside surface equipment.

Some embodiments of the present disclosure relate to an apparatus, referred to herein as a testing tool 100 that can be positioned within an oil and/or gas well 204 that has at least one horizontal section 206. The horizontal section 206 can be partially, substantially or entirely horizontal. The well 204 defines an uphole end 206A and a downhole end 206B (as shown in FIG. 1). The well 204 extends from the surface 200 into a geologic formation 250 below. Oil and/or gas are contained within a reservoir 252 of the geologic formation 250. The horizontal section 206 may be substantially parallel to the surface 200, or not. The horizontal section 206 may be open hole or lined with liner, casing or other type of well pipe that is known in the art, all of which are referred to herein as liner 208. The remainder of the well 204 may be cased, lined or open hole.

As shown in FIG. 1, the horizontal section 206 has a longitudinal axis that is indicated by line X. As will be described further below, the testing tool 100 can be moved along the longitudinal axis X of the horizontal section 206 in order to performed testing operations at different locations of the horizontal section 206. Said another way, the testing tool 100 may be moved towards either the uphole end 206A or the downhole end 206B of the well 204 so as to perform testing operations on different stages of the well 204. This movement along the longitudinal axis X of the horizontal section may also be referred to as moving uphole or moving downhole.

The liner 208 can be perforated to provide the potential for fluid communication between inside of the liner 208 and the reservoir 252. The liner 208 can be perforated by various mechanisms including, but not limited to: explosive perforating, sliding sleeves, burst discs, and abrasive jetting, which are collectively referred to herein as mechanisms for perforating the liner 208. The liner 208 may then comprise various perforated sections 210 that are spaced apart from each other along the horizontal section 206. In some instances, but not all, a fracturing operation may be performed to generate fractures 210A in the geologic formation 250. The fractures 210A may also be referred to as cracks or openings. The fractures 210A may provide one or more fluid pathways between the reservoir 252 and the well 204 so as to facilitate fluid communication between the reservoir 252 and the well 204. Typically, testing tool 100 is positioned in the horizontal section 206 so that the perforated sections 210 are adjacent to the fractures 210A. For the purposes of this disclosure, it is understood that fractures 210A may not be required for the various embodiments of the present disclosure to operate. Furthermore, one or more perforated sections 210 may form a stage with each horizontal section 206 and the horizontal section 206 is divided up into multiple stages of perforated sections 210.

Figure 2A:
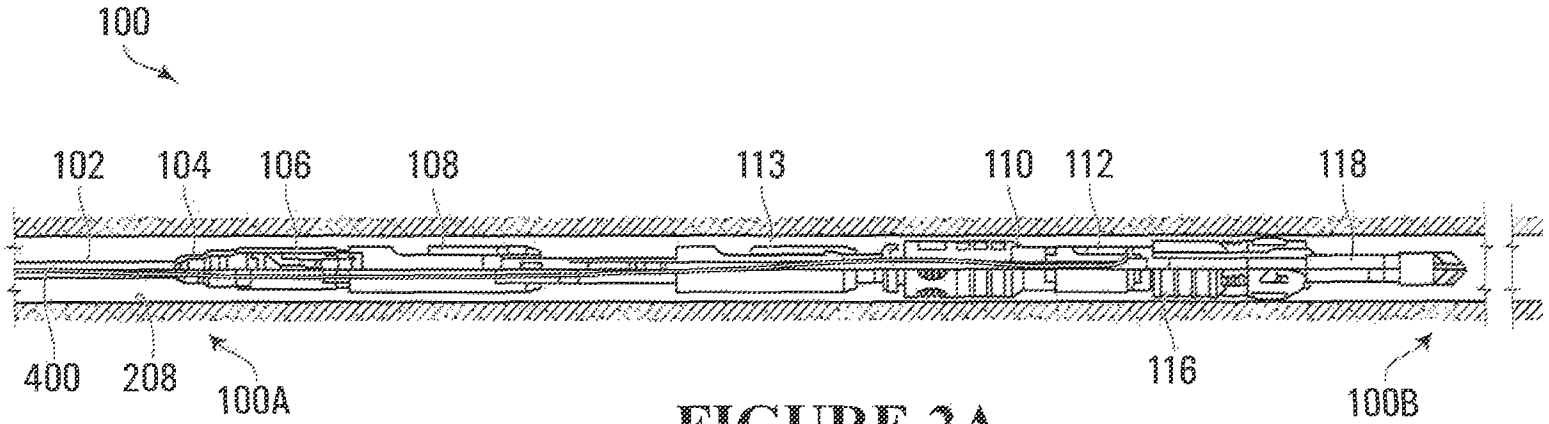
FIG. 2A shows the testing tool in a first configuration and FIG. 2B shows the testing tool in a second configuration.
Figure 2B:
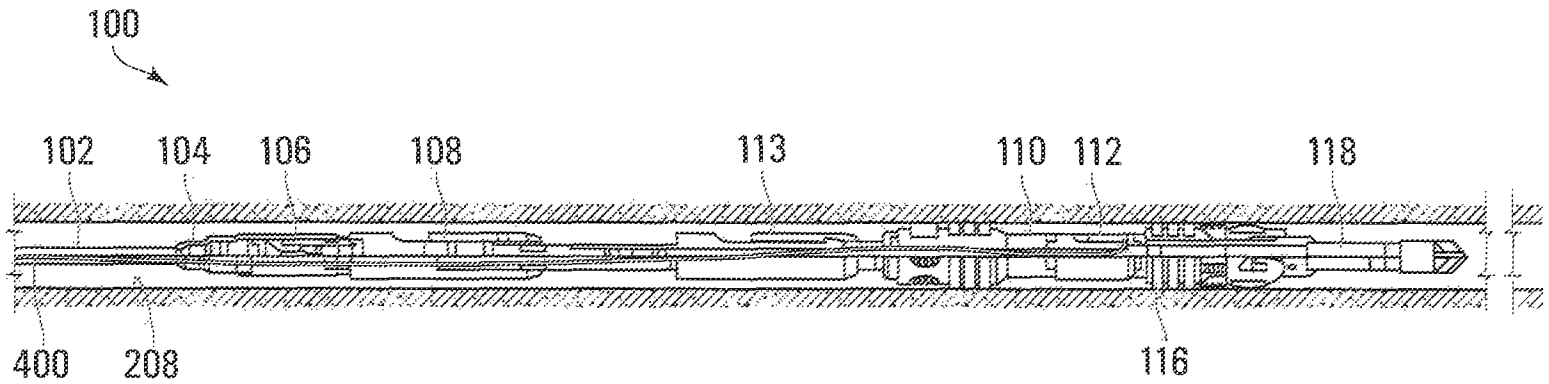

As shown in FIG. 2, the testing tool 100 can change or move between at least two configurations. In a first configuration (see FIG. 2A), the testing tool 100 can move along the longitudinal axis X within the horizontal section 206. In a second configuration (see FIG. 2B) the testing tool 100 engages the liner 208 with sealing mechanisms, as described further below.

The testing tool 100 may be mechanically and fluidly coupled to topside surface equipment 202 by a string of coiled tubing 102. Examples of surface equipment 202 include but are not limited to one or more coiled tubing trucks, an electric generator, one or more pumps such as a reciprocating piston-pumps that can generate as high a pressure as is required to perform fracturing operations while still providing accurate volumetric control. The pumps may be used to pump water or a mixture of water and glycol from a holding tank (not shown). In one embodiment, the testing tool 100 may be operatively coupled to a coiled tubing truck, or other surface equipment 202, at the surface 200. In this embodiment, an uphole end 100A of the testing tool 100 is operatively coupled to a downhole end of a string of coiled tubing 102 so that fluids that are conducted through the coiled tubing 102 are fluidly communicated into the testing tool 102 and so that movement of the coiled tubing 102 can translate into movement of the testing tool 100. For example, the coiled tubing 102 is operatively coupled to the testing tool 100 by a cable-head assembly 104. The coiled tubing 102 may be used to provide fluids from the surface 200 to the testing tool 100 and downhole of the testing tool 100. The coiled tubing 102 may be used to convey one or more electrical conductors 400 from the surface 200 to the testing tool 100. The coiled tubing 102 may also be used to move the testing tool 100 through the well 204 and along the longitudinal axis X of the horizontal section 206.

The testing tool 100 may comprise one or more connected mandrels or tubulars with each mandrel or tubular connected to each other by threading or other known means and providing a hollow bore therethrough. In some instances, the testing tool 100 may comprise one or more mandrels that are at least partially nested within another mandrel.

In some embodiments of the present disclosure, the testing tool 100 can have some or all of the following features in the following order from the uphole end 100A towards the downhole end 100B: the cable-head assembly 104, a pump assembly 106, an optional sensor telemetry assembly 113, an upper packer-assembly 110, a sensor assembly 112, a lower packer-assembly 116 and a bottom connector-assembly 118.

Figure 4:
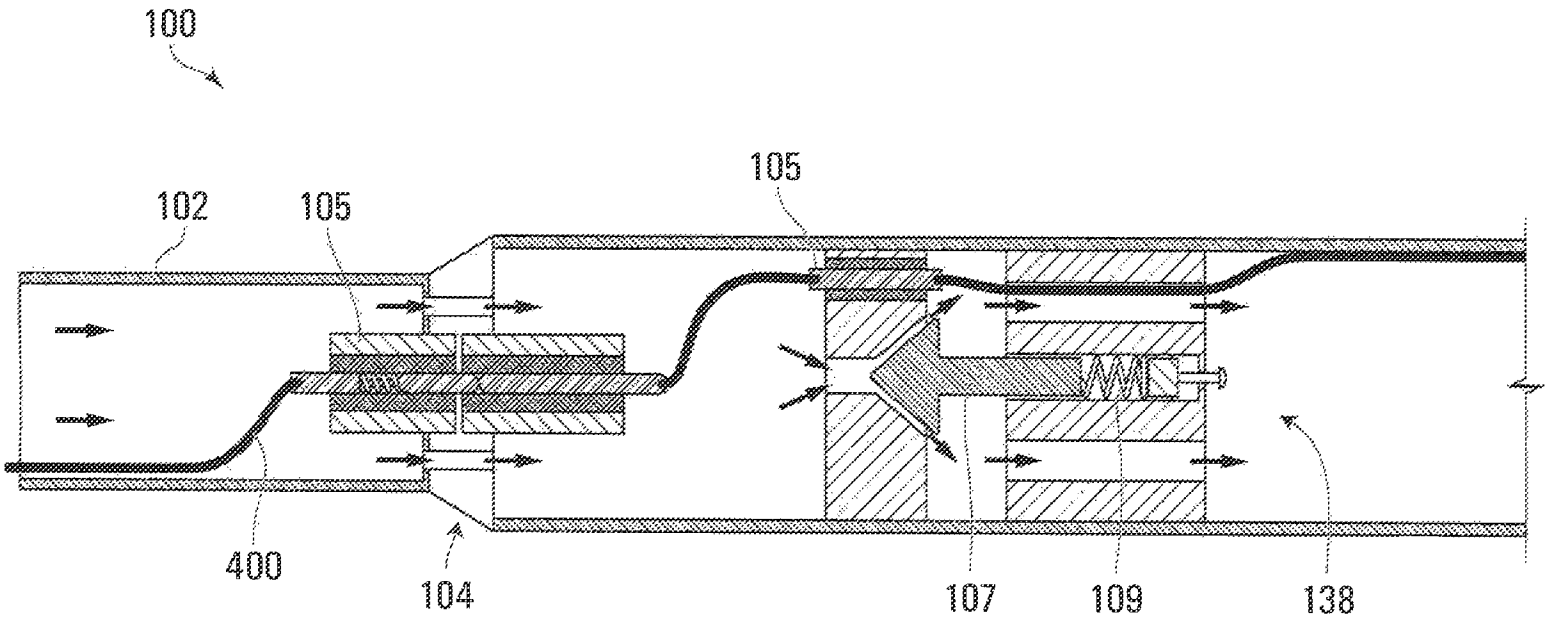
FIG. 4 is a longitudinal, mid-line cross-sectional view of the testing tool of FIG. 1 with a closer view of a fluid control valve towards an uphole end of the testing tool that shows the flow of fluids therethrough.

The cable-head assembly 104 may comprise a holdback valve 138 that controls the flow of fluids through therethrough. FIG. 4 depicts one embodiment of a holdback valve 138 that comprises a biasing-member regulated stem valve 107. When the potential energy in the hydraulic pressure of fluids flowing through the coiled tubing 102 is less than the biasing force of the biasing member 109, the stem valve 107 remains seated in a valve seat 115. In this position, the holdback valve 138 is closed and no fluids will flow past the holdback valve 138. The biasing force is adjustable at the surface and can be set to allow fluids to pass when a predetermined pressure of the fluids in the coiled tubing 102 is achieved. The holdback valve 138 can be set to open when the predetermined pressure is slightly above a calculated true vertical depth hydrostatic downhole pressure to keep the coiled tubing 102 full of fluid at all times. This may save time that would otherwise be required to refill the coiled tubing 102. However, when the pressure of the fluids in the coiled tubing 102 are sufficiently high, the biasing force of the biasing member 109 can be overcome and the valve stem 107 will dislodge from the valve seat 115. In this position, the holdback valve 138 is open and fluids may flow from the coiled tubing 102 through to the portions of the testing tool 100 that are downhole from the holdback valve 138. The fluid flows through the testing tool 100 and can circulate in the well 204 downhole from the testing tool 100 if the testing tool 100 is in the first configuration. In some embodiments of the present disclosure the fluids may flow through the testing tool 100 by one or more flow-through conduits 132. In some embodiments of the present disclosure the fluid flows through the testing tool 100 for driving a hydraulic pump, as described further below, if the tool is in the second configuration. As will be appreciated by those skilled in the art other types of holdback valves 138 that respond to changes in the hydrostatic pressure of fluids within the coiled tubing 102 may also be useful. As will be discussed further below, some embodiments of the present disclosure relate to a testing tool 300 that does not include a hold-back valve 138 and so fluids may flow through the testing tool 300 independent of the pressure of the fluid in the coiled tubing 102.

The cable-head assembly 104 may also include feedthroughs 105 to allow the electrical conductor 400 to pass therethrough. The electrical conductor 400 provides power to at least to the sensor assembly 112, the optional sensor telemetry assembly 113, and optionally to the downhole pump 108 if the pump requires electrical power.

Figure 5:
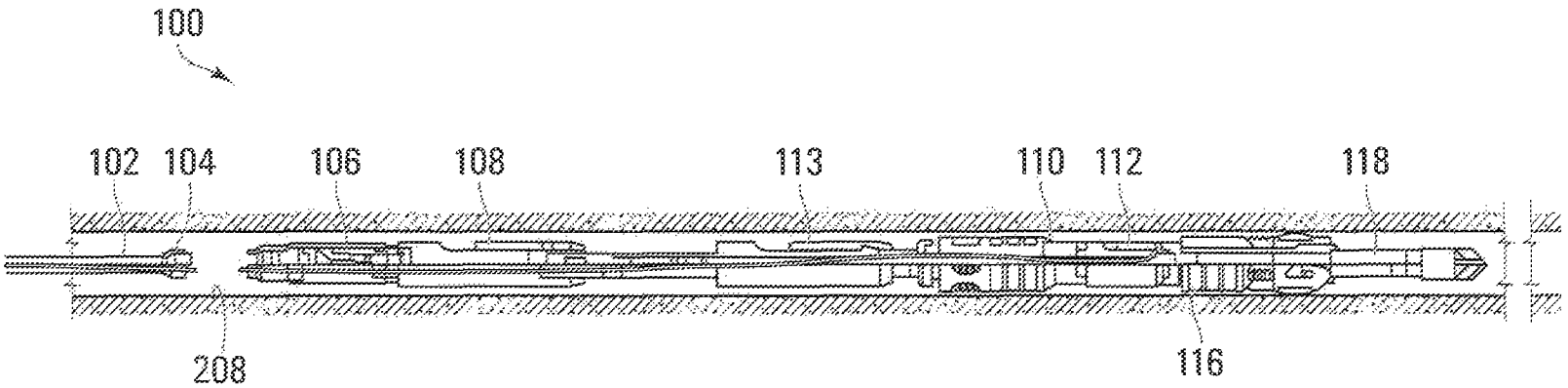
FIG. 5 is a longitudinal, mid-line cross-sectional view of the testing tool of FIG. 1 disconnected from the topside surface equipment.

In some embodiments of the present disclosure, the coiled tubing 102 may be separated from the testing tool 100 at or about the cable-head assembly 104. The coiled tubing 102 may be releasably connected to the cable-head assembly 104 by one or more shear elements that will shear and allow the coiled tubing 102 to release from the testing tool 100 when an uphole force of a predetermined amplitude is exerted on the coiled tubing 102. In these embodiments, one or more feedthroughs 105 for the electrical conductor 400 may also disconnect when the coiled tubing 102 is disconnected from the testing tool 100. As shown in FIG. 5.

Figure 3A:
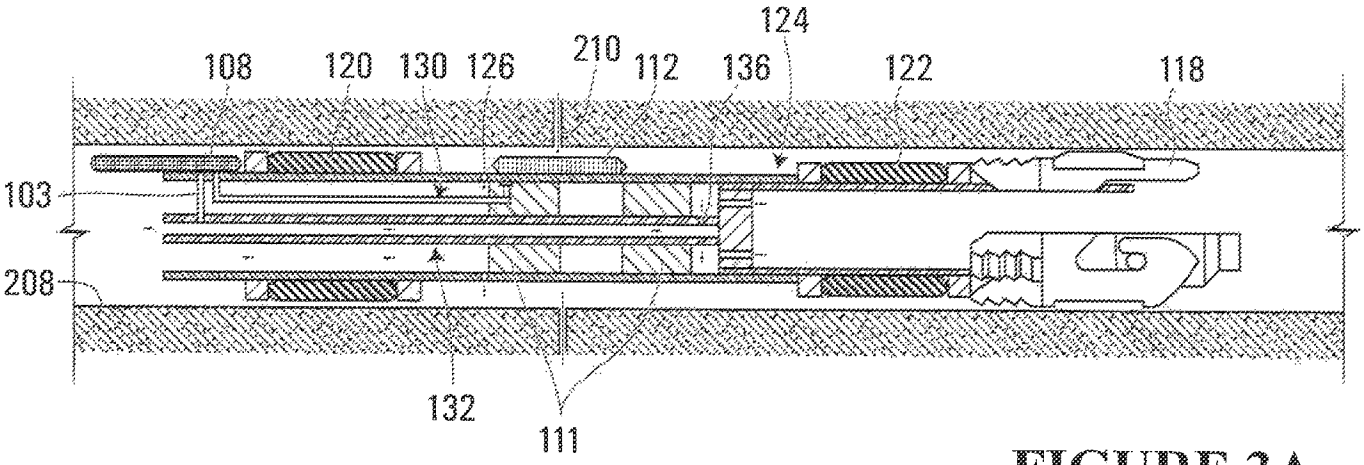
FIG. 3A shows the testing tool in the first configuration and FIG. 3B shows the testing tool in the second configuration.

In some embodiments of the present disclosure, the pump assembly 106 is mounted on a side of a sleeve that allows fluid to pass through it. The pump assembly 106 comprises a downhole pump 108. The downhole pump 108 can be installed and removed at surface by a technician. There can be a port 103 on the side of the pump assembly 106 that allows fluid to flow from the flow-through conduit 132 and into a power section of the downhole pump 108 to hydraulically power the downhole pump 108 (FIG. 3A). A hydraulic line runs from an upper packer-assembly 110 to an inlet of the downhole pump 108. The electrical conductor 400 passes through feedthroughs of the pump assembly 106 to provide electrical power to the downhole pump 108.

In some embodiments of the present disclosure the downhole pump 108 may be a hydraulically driven pump which is powered by the surface-driven flow of fluid through the one or more flow-through conduits 132 of the coiled tubing 102 when the holdback valve 138 is open. In some embodiments of the present disclosure, when the downhole pump 108 is operating, small quantities of test fluid are drawn from the reservoir 252 into an annular space 124 in the vicinity of the sensor assembly 112. Continued operation of the downhole pump 108 moves test fluid from the portion of the annular space 124 between the upper packer-assembly 110 and the lower packer-assembly 116, past the sensor assembly 112 and into the annular space 124 uphole of the upper packer-assembly 110.

In some embodiments of the present disclosure, the downhole pump 108 may be an electrical submersible pump that operates to drive fluids from the downhole end 206A of the horizontal section 206 towards the uphole end 206B. Optionally, the downhole pump 108 may drive fluids within the coiled tubing 102 or within the annular space 124 between the coiled tubing 102 and an outer surface of the well 204 to the surface 200.

Figure 3B:
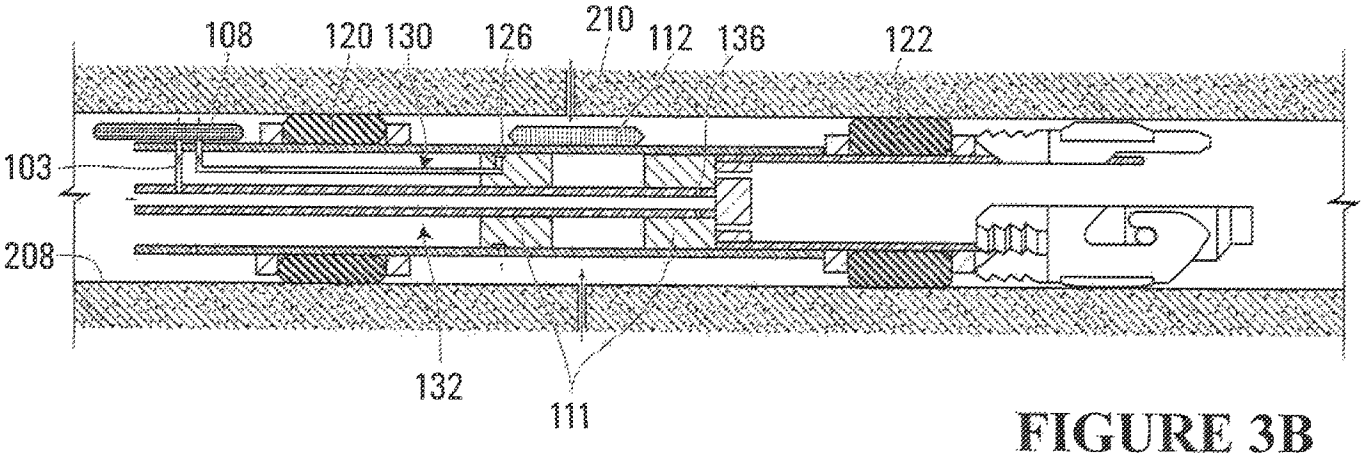

The packer elements 120 and 122 may operate by use one of various commonly used packer activation methods. These methods include compression activation, tension activation, hydraulic activation, or inflatable activation of the packers. For example, the upper packer-assembly 110 may comprise a drag block that expands a set of slips when the testing tool 100 is moved uphole. One example of a drag block is referred to as an auto-J mechanism. A specific movement pattern of the coiled tubing 102 and the testing tool 100 causes the slips to dig into the liner 208 and then squeezes an upper packer-element 120 and a lower packer-element 122 causing the packer elements 120, 122 to expand and provide a hydraulic seal against an inner surface of the liner 208. The upper packer-assembly 110 may also provide a feedthrough (not shown) for the electrical lines 400 to power the sensor assembly 112, and optionally the sensor telemetry assembly 113. The upper packer-assembly 110 provides a test-fluid conduit 130 between the sensor assembly 112 and the pump assembly 108 (FIG. 3A and FIG. 3B). The upper packer-assembly 110 also has a sliding-sleeve assembly 111 which shifts positions when the testing tool 100 is moved uphole or downhole. Shifting of the sliding sleeve 111 may change the fluid path of the testing tool 100 from the first configuration to the second configuration. For example, in the first configuration, fluid may move from the coiled tubing 102 through the one or more flow-through conduits 132 and a downhole port 136 and then through the downhole end 100B of the testing tool 100.

After the specific packer setting movement, the testing tool 100 moves to the second configuration and the sliding-sleeve assembly 111 covers the downhole port 136 (FIG. 2B). In the second configuration, the test-fluid conduit 130 is fluidly connected to the annular space 124 between an outer surface of the testing tool 100 and the liner 208 by aligning the test port 126 with one end of the test-fluid conduit 130. In the second configuration the sliding assembly 111 aligns, or allows the alignment of, the test-fluid conduit 130 with a testing port 126. This creates a fluid flow path from the perforated section 210, into the annular space 124 through the testing port 126, along the test-fluid conduit 130 to the downhole pump 108. The fluids that are being tested by the sensor assembly 112 are referred to herein as the test fluids. As test fluids pass into the annular space 124 between the packer assemblies 110, 116, the sensor assembly 112 may perform one or more testing operations. If the sliding-sleeve assembly 111 is shifted to the first configuration the flow of test fluids to the downhole pump 108 is cut off and a flow restricted path is opened between a hydraulic line from the sensor assembly 112 and the annular space 124. This restricted path allows a slower flow of test fluids for a gradual equalization of pressure imbalances which may restrict subsequent movement or operation of the testing tool 100. For example a draw-down test may cause a partial vacuum which can hinder or prevent repositioning of the testing tool 100.

In some embodiments of the present disclosure the sensor assembly 112 is positioned between the upper packer-element 120 and the lower packer-element 122. The sensor assembly 112 may comprise one or more sensors including but not limited to a telemetry package, a gamma-ray detector, a casing-collar locator, a temperature probe, a fluid-capacitance sensor, a fluid-conductivity sensor, an optical sensor, a pressure probe, an optical spectroscopy sensor, a sensor to measure ultrasonic speed within the tested fluid, a magnetic resonance imaging sensor package, a radioactive density measurement sensor, a fluid-resistivity sensor, a sensor for measuring dielectric properties of the tested fluid, a tuning-fork vibration resonance sensor for measuring the density and viscosity of the tested fluid or combinations thereof. The sensors allow the testing tool 100 to perform one or more testing operations that capture fluid-property data and/or pressure data which the sensor assembly 112 can record and/or communicate to the surface 200 by the telemetry package and known mechanisms or methods. In one embodiment of the present disclosure, the sensor assembly 112 comprises at least one of all of these sensors. In some embodiments of the present disclosure, the fluid-capacitance sensor and/or the conductivity sensor may be used to identify the fluid types within the test fluid (e.g. water, oil or gas). Further, the conductivity sensor may be used to determine the source of any detected water, for example, if the detected water is reservoir water, fracking water or wellbore water. Because flow of the tested fluid may be a mixture of bubbles of oil, water or gas. This conductivity sensor may also count the length and duration of the bubbles. The optical sensor can be used to determine if the test fluid is a liquid or a gas and to count the number and size of any bubbles present in the test fluid. The casing-collar locator and gamma-ray detector may be used to get the testing tool 100 at a desired position along the well 204. The pressure and temperature sensors may be used for drawdown and buildup analysis.

In some embodiments of the present disclosure the sensor assembly 112 allows side loading of the desired sensors for ease of access. The sensors will be electrically connected at one end, for example the uphole end 206A. The sensors can be installed and removed at the surface 200 by a technician to provide a testing package of desired sensors and to maintain and replace sensors as required. The sensor assembly 112 allows fluid flow therethrough via the test-fluid conduit 130 so that the sensors can access the test fluids but to avoid wetting sensitive electronics of the sensor assembly 112.

The lower packer-assembly 116 is similar to the upper packer-assembly 110. The lower packer-assembly 116 does not have a sliding-sleeve assembly or any electrical conductors or hydraulic lines, as the upper packer-assembly 110 does. The lower packer-assembly 116 operates in the same manner for setting and releasing the lower packer-element 122.

The bottom connector-assembly assembly 118 is connected to the downhole end of the testing tool 100. The bottom connector-assembly assembly 118 is configured to be coupled to various standard coiled tubing tools such as but not limited to jetting nozzles for cleaning or a drill bit.

Figure 6:
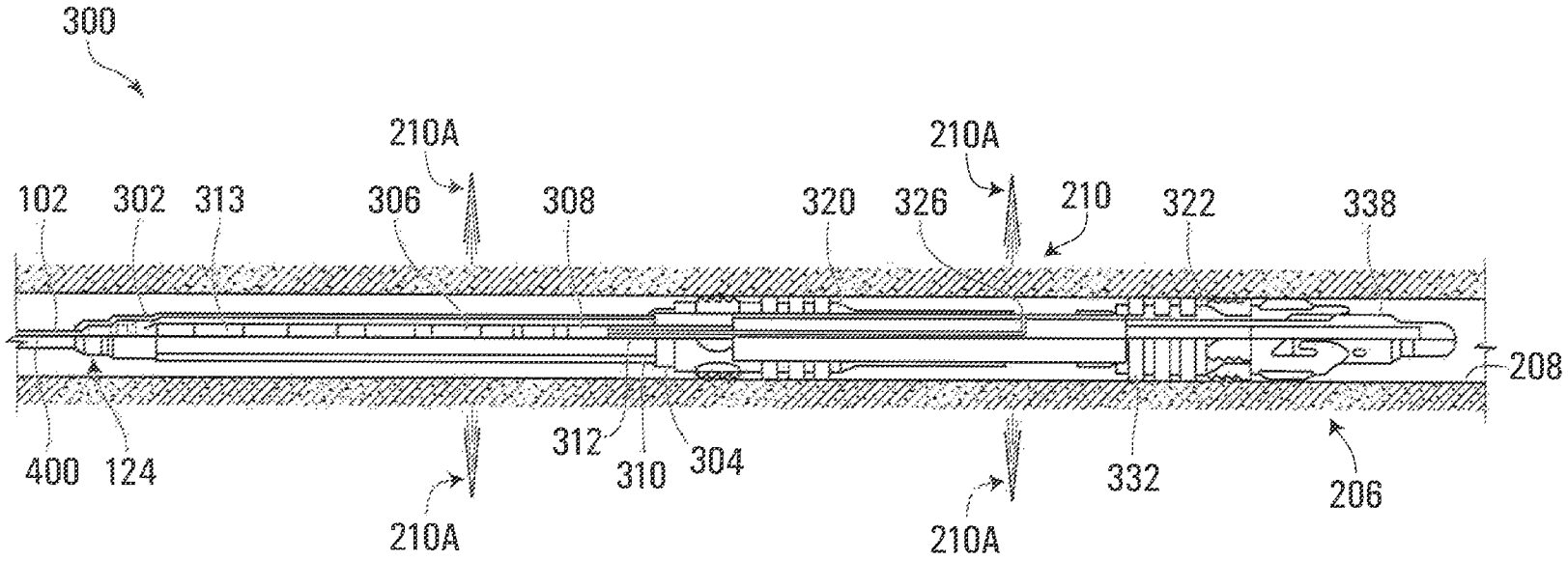
FIG. 6 is a longitudinal, mid-line cross-sectional view of another embodiment of a testing tool according to the present disclosure.

FIG. 6 shows another embodiment of a testing tool 300 positioned within a liner 208 that forms part of the horizontal section 206. The testing tool 300 can be operatively coupled to the coiled tubing 102 as described herein above regarding the testing tool 100. The testing tool 300 performs similar functions and testing operations as described herein above regarding the testing tool 100.

The testing tool 300 can include an electric release 302, a telemetry and control electronic section 313, an electrically powered downhole-motor 306, a downhole pump 308, an optional collar locator 310, a sensor assembly 312, an equalization sub 304, an upper packer-element 320, a lower packer-element 322, a testing port 326, a flow-through conduit 332 and a flow-control valve 338. Optionally, the testing tool 300 can also include a bottom connector-assembly as described herein above. The electric downhole-motor 306 can receive power from surface by an electric power conductor 400 that extends from the surface 200 through the coiled tubing 102. The conductor 400 can be a single conductor or multiple conductors. The upper packer-element 320 and the lower packer-element 322 can be actuated between a set and an unset position in a similar manner as described above, or by a hydraulic mechanism. For example, the hydraulic packer set described in U.S. Pat. No. 9,187,989, the entire disclosure of which is incorporated herein by reference, may be a suitable type of packer set for use with either of the testing tools 100, 300.

Figure 7:
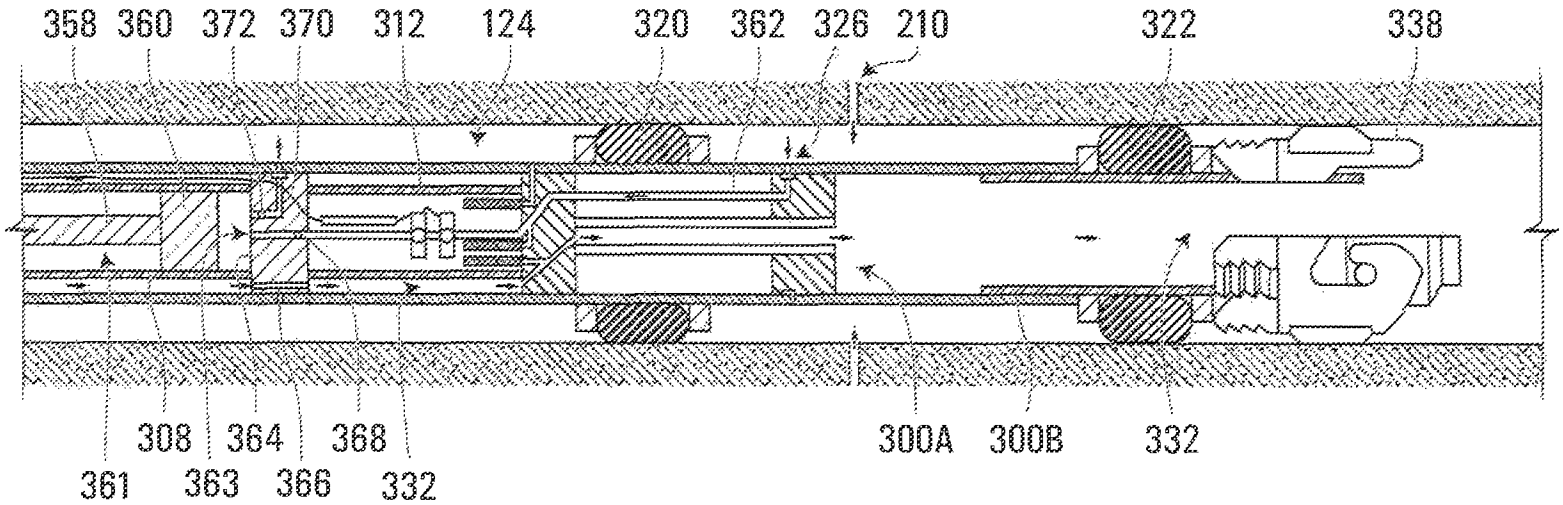
FIG. 7 is a longitudinal, mid-line cross-sectional view that shows the flow of fluids through a portion of the testing tool shown in FIG. 6.

At least one difference between the testing tool 100 and the testing tool 300 is that the sensor assembly 312 is positioned in fluid communication with a position between the two packer assemblies 110, 116 and the downhole pump 308, without being restricted to a position in between the two packer assemblies 110, 116 (FIG. 7). For example, the sensor assembly 312 may be in fluid communication with the position between the two packer assemblies 110, 116 via the testing port 326 and the sensor assembly 312 may be in fluid communication with the downhole pump 308 by a test-fluid conduit 362. In some embodiments of the testing tool 300 the testing port 326 is not closed by a sliding sleeve, rather the testing port 326 is open. The testing port 326 is positioned between the two packer elements 320, 322 and the testing port 326 is in fluid communication with the test-fluid conduit 362 that extends from the testing port 326 to the downhole pump 308. The test-fluid conduit 362 passes through the sensor assembly 312 and the one or more sensors therein can perform testing operations on the test fluid within the test-fluid conduit 362. The sensor assembly 312 can include the same compliment of sensors as described herein above in reference to the sensor assembly 112. The flow of the test fluid is shown by a series of arrows. FIG. 7 also show the flow of fluids from the coiled tubing 102 through the flow-through conduit 332 by further arrows.

The downhole pump 308 defines a shaft chamber 361 in which a pump shaft 358 and a piston 360 are housed. The shaft chamber 361 can be filled with a typical pump chamber fluid, such as a lubricating oil, or the like. The pump shaft 358 is operatively coupled to the electric downhole-motor 306 to provide accurate control over actuating movements of the pump shaft 358 and the piston 360 connected thereto. The downhole pump 308 can be separated from the sensor assembly 312 by a check-valve sub 364. A pump chamber 363 is defined between a face of the piston 360 and the check-valve sub 364. The check-valve sub 364 defines an end of the test-fluid conduit 362 that is opposite to the testing port 326. As such, when the piston 360 moves away from the check-valve sub 364, the volume of the pump chamber 363 increases causing test fluids to flow through the test-fluid conduit 362, through the sensor assembly 312 and into the pump chamber 363. The check-valve sub 364 may include a first one-way check valve 368 that prevents the backflow of test fluids back into the sensor assembly 312. Test fluids within the pump chamber 363 can be expelled into the annular space 124 by an output conduit 370, which can include a second one-way valve 372 to prevent the ingress of fluids from the annular space 124 into the pump chamber 363. In some embodiments of the present disclosure the downhole pump 308 can be a double-acting pump that can expel and draw fluids into the downhole pump as the piston 360 moves in both directions. In some embodiments of the present disclosure the check-valve sub 364 can define an extension 366 of the flow-through conduit 332.

In some embodiments of the present disclosure relate to a pressure sensing package that can be used with the testing tools 100, 300 for detecting the pressure within different regions of the annular space 124. The pressure sensing package can comprise a first pressure-sensor that is positioned between the two packer elements 220, 222, a second pressure-sensor that is positioned uphole of the upper packer-element 220 for measuring the pressure within the annular space 124 and a third pressure-sensor that is positioned downhole of the lower packer-element 222. The pressure information from these three pressure sensors, or only two of them, can be used to detect if there is any fluid leakage between the stages uphole or downhole of the stage that is being tested. These types of fluid leaks may occur in an open-hole wellbore with a leaking open-hole packer, when there is a suboptimal cement job, combinations thereof or for other reasons. These types of fluid leaks can cause inefficient fracturing operations and inefficient production of produced fluids from the reservoir 252 into the well 204.

Figure 8:
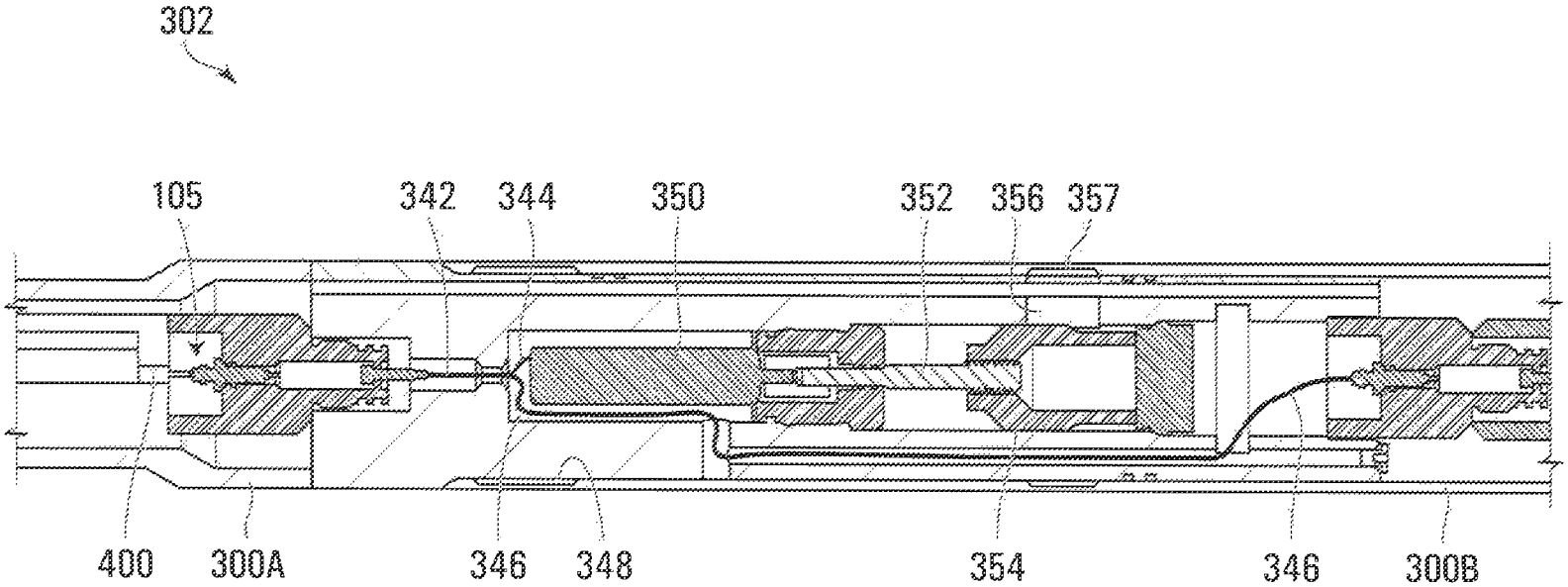
FIG. 8 is a longitudinal, mid-line cross-sectional view of an electric release for use with the testing tools of the present disclosure.
Figure 9A:
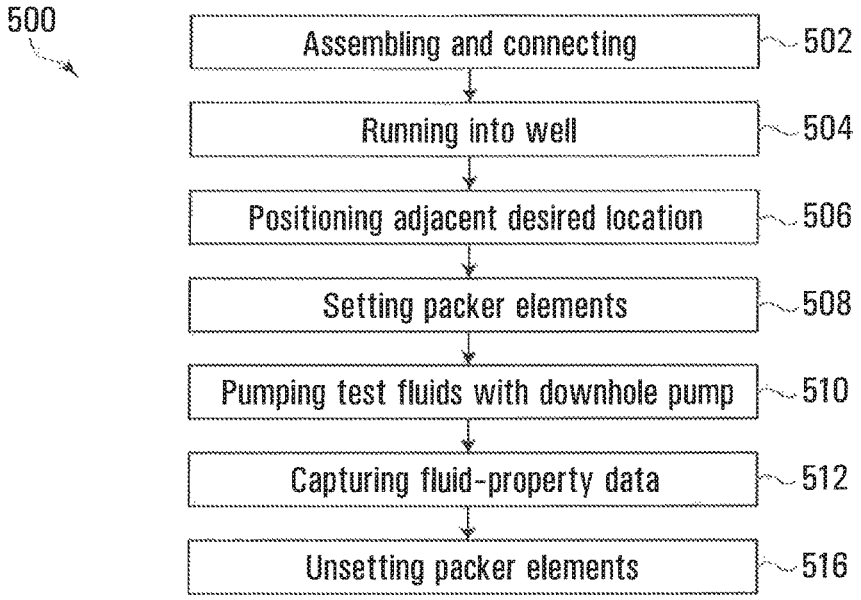
FIG. 9A is a first method and FIG. 9B shows some further optional steps of the method shown in FIG. 9A.
Figure 9B:
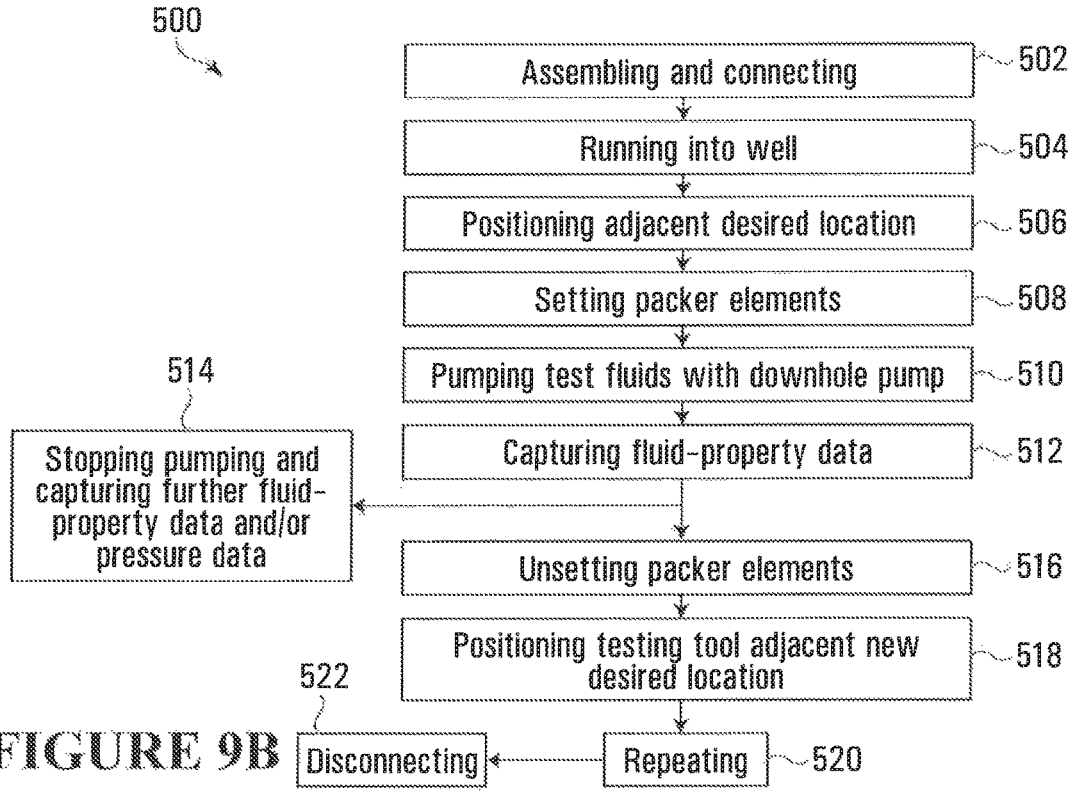

FIG. 8 shows one embodiment of the electric release 302. The electric release 302 allows the user to separate the testing tool 300 into an upper section 300A from a lower section 300B for example if the testing tool 300 becomes stuck downhole. The upper section 300A is releasably connectible to the lower section 300B. The upper section 300A may include one or more of the telemetry and control electronics section 313, the electric downhole-motor 306 or the sensor assembly 312. The lower section 300B can include the packer elements 320, 322 the flow-control valve 338 and the bottom connector-assembly 118. The upper section 300A can be pulled uphole by the coiled tubing 102 and the lower section 300B can be recovered by a fishing operation.

The electric release 302 includes at least one electrical feedthrough 105 for the conductor 400, after which the conductor 400 is referred to as the second conductor 342, which can diverge into an upper conductor 344 that provides electrical power to a release motor 350 and a lower conductor 346 that provides electrical power to the remainder of the testing tool 300. The electric release 302 can also include one or more power controls, such as one or more diodes, electronic circuits, electronic components or combinations thereof that can control the flow of power to a release motor 350. The release motor 350 can be operatively coupled to a release gear 352 that is operatively coupled to a release sleeve 354. The release motor 350, the release gear 352 and the release sleeve 354 are also part of the upper section 300A. When the upper section 300A is releasably connected to the lower section 300B, the release sleeve 354 is positioned to retain one or more collapsible fingers 356 of the upper section 300A in corresponding finger-retaining grooves 357 of the lower section 300B.

The release motor 350 can be powered by electric power that is of an opposite polarity to the electric power that powers the remainder of the testing tool 300. For example the release motor 350 can be powered by negative voltage whereas the remainder of the testing tool 300 can be powered by positive voltage, or vice versa. The power controls and the use of electric power of a different polarity call allow the release motor 350 to be powered separately from the remainder of the testing tool 300.

When powered, the release motor 350 actuates the release gear 352, for example the release gear 352 may be a worm gear that rotates and linearly moves the release sleeve 354 towards or away from the release motor 350. Alternatively, the release gear 352 may simply pull or push the release sleeve 354. When the release sleeve 354 moves a predetermined distance relative to the release motor 350 that causes the one or more collapsible fingers 356 to be released from the corresponding finger-retaining grooves 357 that are defined on the inner surface of the lower section 300B. When the one or more collapsible fingers 356 are released, the upper section 300A can be separated from the lower section 300B. When separated from the upper section 300A, fishing profiles 348 on an uphole end of the lower section 300B are exposed facilitate recovery by a fishing operation.

In some embodiments of the present disclosure, the testing tool 300 can include the flow-control valve 338. The flow-control valve 338 can be useful when the packer elements 320, 322 are hydraulically actuated. The flow-control valve 338 can be set to actuate at a predetermined flow rate or pressure so that when fluids that are conducted through the testing tool 300, via the flow-through conduit 332, achieve the predetermined flow rate or pressure the flow-control valve 338 will actuate and direct that fluid towards pistons (not shown) that actuate the packer elements 320, 322 into the set position. In some examples the predetermined flow rate may be between about 150 and 250 liters per minute. Once the packer elements 320, 322 are set, the fluid pressure within the coiled tubing 102 can be held at a sufficient level so as to keep the packer elements 320, 322 sealingly engaged with the inner surface of the liner 208 or the open hole wellbore, as the case may be. When the fluid flow rates or pressures are below the predetermined value, the flow-control valve 338 will allow fluids to pass downhole of the testing tool 300. In other embodiments of the present disclosure, the packer elements 320, 322 themselves may be inflatable. For example, the packer elements 320, 322 can contain an internal plenum that can be put into and out of fluid communication with the flow-through conduit 132 by actuation of the flow-control valve 338. For example, if the fluids delivered through the coiled tubing 102 are above the predetermined rate or pressure, the flow-control valve 338 can direct the fluids to inflate the packer elements 320, 322 directly. When the fluids delivered through the coiled tubing 102 decrease below the predetermined rate or pressure, the flow-control valve 338 can actuate again and release the fluids from the packer elements 320, 322 while permitting fluids to pass through the flow-control valve 338.

Some embodiments of the present disclosure the testing tool 300 includes the equalization sub 313. The purpose of the equalization sub 304 is to release a negative pressure that can generate between the two packer elements 320, 322. This negative pressure can be created during testing operations and it can hinder or prevent the packer elements 320, 322 from returning to the unset position. As such, the equalization sub 304 can be operatively connected to the coiled tubing 102 so that an uphole movement of the coiled tubing 102 can shift a sleeve (not shown) to provide fluid communication between the annular space 124 and the space between the two packer elements 320, 322.

In some embodiments of the present disclosure, the testing tools 100, 300 may have an outer diameter of between about 2 inches to about 6 inches or between about 3 inches to about 5 inches or about 3 and ⅜ inches (one inch equals about 2.54 cm). In some embodiments of the present disclosure, the testing tools 100, 300 may be run into the well 204 with coiled tubing 102 of any outer diameter, for example coiled tubing 102 with an outer diameter of about 1.5 inches. In some embodiments of the present disclosure, the testing tools 100, 300 may have a temperature tolerance of about 932° F. (about 500° C.) or about 752° F. (about 400° C.) or about 617° F. (about 325° C.). In some embodiments of the present disclosure, the testing tools 100, 300 may have an upper pressure tolerance of about 20,000 pounds per square inch (psi, 1 psi equals about 6.89 kPa) or about 12,000 psi or about 10,000 psi.

In operation, the testing tools 100, 300 may be used to perform testing operations of a perforated horizontal section 206 of a well 204 according to embodiments of the present disclosure. In one embodiment of the present disclosure, a method 500 for deploying and using the testing tools 100, 300 comprises some or all of the following steps: assembling 502 the testing tool 100, 300 and operatively coupling the testing tool 100, 300 to the coiled tubing 102; running 504 the coiled tubing 102 and the testing tool 100, 300 into the well 204; positioning 506 the testing tool 100, 300 substantially adjacent a desired perforated section 210 of the well 204 where testing operations will be conducted; setting 508 the packer elements 120, 122, 320, 322 establishing fluid communication between the sensor assembly 112 and the desired perforated section 210; pumping 510 test fluid by operating the downhole pump 108, 308 at a first output parameter and capturing fluid property and/or pressure data from the test fluids as they are drawn into the sensor assembly 112, 312; capturing 512 fluid-property data from the test fluids; stopping 514 the downhole pump 108 and capturing further fluid-property data from the test fluids; and unsetting 516 the packer elements 120, 122. The method 500 may include a step of positioning 518 the testing tools 100, 300 to another desired location for further testing of test fluids within the well 204 and repeating 520 the previous steps of the method 500. The method 500 may further include a step of disconnecting 522 the coiled tubing 102 from the testing tool 100, 300 by overcoming shear connections at the uphole end of the testing tool 100, 300 or by reversing the polarity of the electrical power that powers the testing tool 100, 300 in order to utilize the electric release 302.

During the assembling step 502 the desired sensors are assembled at the surface 200 within the sensor assembly 112, 312 and the testing tool 100, 300 is operatively connected to the coiled tubing 102. The sensors of the sensor assembly 112, 312 are tested, calibrated and otherwise prepared to travel down into the well 204 and the environment therein. The coiled tubing 102 and the testing tool 100, 300 are then run 504 down into the well 204.

During the positioning steps 506, 518 the testing tool 100, 300 is positioned at a desired location adjacent a desired stage of the horizontal section 206 adjacent a perforated section 210, which are optionally adjacent fractures in the geologic formation 250. As a further option, the position of the testing apparatus 100 relative to the first stage may be corrected based upon a short pass with the collar locator 310. If required, the position of the testing tool 100 may be adjusted accordingly by moving the coiled tubing 102 either further uphole or further downhole.

During the setting step 508 the packer elements 120, 122, 320, 322 are set in the desired position within the well 204 and a step of establishing fluid communication between the sensor assembly 112, 312 and the test fluids is achieved. In some embodiments of the present disclosure the packer elements 120, 122 are set by moving the packer assemblies 110, 116 past the perforated section 210, then pulling the coiled tubing 102 uphole to set the packer elements 120, 122. As will be appreciated by one skilled in the art, an opposite downhole movement or other movements of the coiled tubing 102 can also be used to set the packer elements 120, 122. Alternatively, the setting step 508 can include increasing the flow rate of the fluids delivered through the coiled tubing 102 into the testing tool 100, 300 are above the predetermined level so as to actuate the flow-control valve 338, which redirects the delivered fluids to hydraulically actuate the packer elements 320, 322 as described herein above. In a further alternative, the packer elements 320, 322 themselves may be inflatable and in fluid communication with the flow-through conduit 132 that is regulated by the flow-control valve 338. For example, if the fluids delivered through the coiled tubing 102 are above the predetermined level, the flow-control valve 338 can direct the fluids to inflate the packer elements 320, 322 directly.

In the desired position, the portion of the annular space 124 that is between the two packer elements 120, 122 is positioned adjacent the perforated section 210 within the selected stage. In the desired position, the testing port 126, 326 is also positioned adjacent the perforated section 210.

During the step of setting 508 the packer elements 120, 122, the sliding-sleeve assembly 111 is also moved to transition the testing tool 100 from the first configuration to the second configuration. In the second configuration, any test fluids that are flowing from the reservoir 252 into the annular space 124 are fluidly communicated to the sensor assembly and can be tested by the sensor assembly 112 to test static pressure and temperature of the fluids within the annular space 124 and those test results can be captured 512.

Alternatively, the sensor assembly 312 can be in fluid communication with the test fluids from the annular space 124 between the set packer elements 320, 322 to capture 512 test results without requiring movement of any sliding sleeve.

The method 500 may include a step of opening the holdback valve 138 by engaging a topside pump, as part of the surface equipment 202, to pump fluids down the coiled tubing 102 with sufficient hydrostatic pressure to overcome the holdback valve 138, which in turn allows fluids to flow into the portions of the testing tool 100 that are downhole from the holdback valve 138. The volumes and pressures introduced by the topside equipment may be recorded. Alternatively, if the testing tool 100, 300 is used without the holdback valve 138, this step of opening the holdback valve 138 is not required.

During the step of pumping 510 fluid with the downhole pump 108, 308, when the holdback valve 138 is in the open position or is not present, the downhole pump 108, 308 will engage and pump in unison. As test fluids are drawn through the annular space 124 they flow past the sensor assembly 112, 312 which captures the test results including but not limited to test fluid: pressures, fluid capacitance, temperatures and other fluid-property data of the test fluids, as determined by the package of sensors that are included in the sensor assembly 112, 312. The downhole pump 108, 308 can be operated at a first-output parameter so that the amount of test fluid pumped is kept to a low level and the test fluids are kept below the bubble point. Then the downhole pump 108, 308 is stopped 514 and the test fluids will continue to flow into the annular space 124. After the passage of time the pressure within the annular space 124 will substantially equilibrate with the pressure of the reservoir 252. This equilibrium pressure and the timing and the pressure profile to achieve this equilibrium may be captured as pressure data as a measure of the reservoir pressure, permeability, the stimulated reservoir volume (SRV) or other reservoir properties that can be captured from pressure transient analysis and/or rate transient analysis.

Capturing 512 the test results can include either recording the test results on some form of electronic memory upon the testing tool 100, 300 or communicating the test results back to the surface 200. Once all test results are captured 512, the packer elements 120, 122, 320, 322 can be unset 516 by moving the coiled tubing 102 or decreasing the flow rate or hydrostatic pressure of the fluids passing through the flow-control valve 338. This will cause the testing tool 100 to move from the second configuration back to the first configuration. The coiled tubing 102 may be moved at surface to position 518 the testing tool 100 adjacent another a new desired location adjacent or proximal to a new perforated section 210 for repeating 520 the testing procedures on another stage of the horizontal section 206. The method 500 can be repeated until testing operations are performed on all desired stages of the well 204. As described above, the coiled tubing 102 may need to be moved in order to actuate the equalization sub 304 in order to relieve any negative pressure between the packer elements 320, 322 and the annular space 124.

In some embodiments of the present disclosure the method can include a step of circulating debris out of the testing tool 100, 300 by a surface pump that can pump a high pressure bolus of fluid down the coiled tubing 102 which will flow past the holdback valve 138, if present, and circulate the fluids out the downhole end 100B of the testing tool 100, 300. This bolus may be useful for circulating debris out of the downhole end of the testing tool 100, 300, for cleaning up the well 204, delivering fluids to any further tools that are downhole of the testing tool 100, 300 or for introducing friction reducing fluids downhole of the testing tool 100, 300.

If the testing tool 100 becomes lodged or locked within the well 204, in some embodiments of the present disclosure the disconnecting step 522 can be performed by pulling the coiled tubing 102 uphole with a sufficient force to overcome the shear features in the cable-head assembly 104. This will releasing the testing tool 100 from the coiled tubing 102 (FIG. 5). Alternatively, if the upper section of the testing tool 100, 300 can be disconnected 522 from the lower section by using the electric release 302. The release motor 350 can then be powered up with a voltage that is of an opposite polarity as the voltage that is used to power the remainder of the testing tool 100, 330 so as to disengage the collapsible fingers 356 from the finger-retaining grooves 357. After which the coiled tubing 102 can be pulled uphole along with the upper section of the testing tool 100, 300. A fishing operation can then be performed to retrieve the lower section of the testing tool 100, 300.

We claim:

1. A testing tool for testing individual stages of a well, the testing tool comprising:

an uphole end and a downhole end, the uphole end is operatively connectible to a coiled tubing string;

a downhole pump, an upper packer-assembly and a lower packer-assembly;

a sensor assembly comprising one or more sensors, the sensor assembly is in fluid communication with a position between the two the packer assemblies and the downhole pump; and a flow-through conduit for receiving fluids from the coiled tubing string and for conducting said fluid between the uphole end and the downhole end.

2. The testing tool of claim 1, wherein the uphole end comprises a cable-head assembly for controlling the flow of fluids therethrough.

3. The testing tool of claim 2, wherein the cable-head assembly comprises one or more shear elements that are releasably connectible to the coiled tubing string.

4. The testing tool of claim 1, wherein the uphole end comprises an electric release that is releasably connectible to the coiled tubing string.

5. The testing tool of claim 1, wherein the sensor assembly comprises one or more of the following sensors: a telemetry package, a gamma-ray detector, a casing-collar locator, a temperature sensor, a fluid-capacitance sensor, a fluid-conductivity sensor, an optical sensor, a pressure sensor, an optical spectroscopy sensor, a sensor to measure ultrasonic speed, a magnetic resonance imaging sensor package, a radioactive density measurement sensor, a fluid-resistivity sensor, a sensor for measuring dielectric properties of the tested fluid, a tuning-fork vibration resonance sensor for measuring the density and viscosity of the tested fluid and combinations thereof.

6. The testing tool of claim 1, further comprising a first pressure-sensor that is positioned between the upper packer-assembly and the lower packer-assembly, a second pressure-sensor that is positioned uphole of the upper packing-assembly and a third pressure-sensor that is positioned below the lower packer-assembly.

7. The testing tool of claim 1, wherein the downhole end comprises a flow-control valve.

8. The testing tool of claim 7, wherein the upper packer-assembly and the lower packer-assembly are hydraulically actuated.

9. The testing tool of claim 7, wherein the upper packer-assembly comprises an upper packer element and the lower packer-assembly comprises a lower packer element, the upper and lower packer elements both comprise an internal plenum and actuation of the flow-control valve controls fluid communication between the internal plenums and the flow-through conduit.

10. The testing tool of claim 1, further comprising an equalization sub for releasing a negative pressure between the upper packer-assembly and the lower packer-assembly.

11. A method comprising steps of:

a. connecting a testing tool to one end of coiled tubing;

b. running the coiled tubing and the testing tool into a well;

c. circulating fluids through the coiled tubing and out of a downhole end of the testing tool;

d. positioning the testing tool substantially adjacent a first perforated section of the well;

e. setting a first packer element on one side of the first perforated section of the well and a second packer element on an opposite side of the desired perforated section;

f. establishing fluid communication between a sensor assembly of the testing tool and the first perforated section;

g. pumping fluid through a downhole pump of the testing tool at a first output parameter;

h. capturing fluid-property data and/or pressure data from test fluids as they are pumped towards the downhole pump; and i. unsetting the packer elements.

12. The method of claim 11, wherein the capturing step captures fluid-property data and pressure data from the test fluids.

13. The method of claim 11, further comprising a step of stopping (i) the downhole pump and capturing further fluid-property and/or pressure data from the test fluids.

14. The method of claim 11, further comprising a step of positioning (j) the testing tool adjacent a second perforated section of the well following the step of unsetting the packer elements.

15. The method of claim 14, further comprising a step of repeating steps (a) through (g) following the step of positioning (j).

16. The method of claim 11, further comprising a step of releasing the testing tool from the coiled tubing.

17. The method of claim 16, wherein the step of releasing comprises a step of providing electrical power to a release motor and separating an upper section of the testing tool from a lower section of the testing tool.

18. The method of claim 11, further comprising a step of circulating fluids through the coiled tubing and out of the downhole end of the testing tool after the step (h) of capturing fluid-property data and/or pressure data from test fluids.

* * * * *